US011290822B2

(12) United States Patent
Gao et al.

(10) Patent No.: US 11,290,822 B2
(45) Date of Patent: Mar. 29, 2022

(54) HIGH-PITCHED LOUDSPEAKER

(71) Applicant: SUZHOU SONAVOX ELECTRONICS CO., LTD, Jiangsu (CN)

(72) Inventors: Peng Gao, Jiangsu (CN); Guoqiang Chai, Jiangsu (CN); Jie Chen, Jiangsu (CN); Yuping Xie, Jiangsu (CN); Jianming Zhou, Jiangsu (CN)

(73) Assignee: SUZHOU SONAVOX ELECTRONICS CO., LTD, Jiangsu (CN)

( * ) Notice: Subject to any disclaimer, the term of this patent is extended or adjusted under 35 U.S.C. 154(b) by 73 days.

(21) Appl. No.: 16/495,782

(22) PCT Filed: Sep. 21, 2018

(86) PCT No.: PCT/CN2018/106913
§ 371 (c)(1),
(2) Date: Sep. 19, 2019

(87) PCT Pub. No.: WO2019/218564
PCT Pub. Date: Nov. 21, 2019

(65) Prior Publication Data

US 2021/0099803 A1 Apr. 1, 2021

(30) Foreign Application Priority Data

May 14, 2018 (CN) ..... 201810455443.8

(51) Int. Cl.
*H04R 9/02* (2006.01)
*H04R 1/28* (2006.01)
*H04R 9/06* (2006.01)

(52) U.S. Cl.
CPC ..... *H04R 9/025* (2013.01); *H04R 1/288* (2013.01); *H04R 9/06* (2013.01); *H04R 2400/11* (2013.01)

(58) Field of Classification Search
CPC ..... H04R 9/025; H04R 1/288; H04R 9/06; H04R 2400/11; H04R 9/022; H04R 9/063
(Continued)

(56) References Cited

U.S. PATENT DOCUMENTS 5,802,195 A * 9/1998 Regan ..... H04R 17/00 310/324
9,485,587 B1 * 11/2016 Skramstad ..... H04R 9/025
(Continued)

FOREIGN PATENT DOCUMENTS

CN 202979242 U 6/2013
CN 103945311 A 7/2014
(Continued)

OTHER PUBLICATIONS

International Search Report and Written Opinion for PCT Application No. PCT/CN2018/106913, dated Dec. 21, 2018 in 8 pages.

*Primary Examiner* — Ryan Robinson
*Assistant Examiner* — Julie X Dang
(74) *Attorney, Agent, or Firm* — Schmeiser, Olsen & Watts, LLP

(57) ABSTRACT

The present disclosure relates to a high-pitched loudspeaker, which widens the starting frequency of the high-pitched loudspeaker, and the high-pitched loudspeaker has a smoother intermediate frequency curve and less distortion. A high-pitched loudspeaker comprises a magnetic circuit system, a voice coil, and a diaphragm connected to the voice coil, wherein a first cavity is formed between the magnetic circuit system and the voice coil and the diaphragm, the high-pitched loudspeaker further comprises a back cover,
(Continued)

the magnetic circuit system is arranged between the diaphragm and the back cover, and a second cavity is formed between the back cover and the magnetic circuit system, a through-hole is opened on the magnetic circuit system which communicates the first cavity and the second cavity to constitute an air gap cavity of the high-pitched loudspeaker.

9 Claims, 9 Drawing Sheets

(58) Field of Classification Search
USPC ..... 381/413, 412, 396, 398, 426, 403, 404, 381/405, 397, 420, 421, 414, 194, 199, 381/205, 428; 181/169, 172, 166, 153, 181/160
See application file for complete search history.

(56) References Cited

U.S. PATENT DOCUMENTS

| | | | | |
|---|---|---|---|---|
| 2004/0008857 | A1* | 1/2004 | Marnie | H04R 1/20 381/397 |
| 2007/0003100 | A1* | 1/2007 | Liu | H04R 1/028 381/412 |
| 2009/0046886 | A1 | 2/2009 | Lin | |
| 2011/0150264 | A1* | 6/2011 | Konuma | H04R 9/025 381/398 |

FOREIGN PATENT DOCUMENTS

| | | | |
|---|---|---|---|
| CN | 204906712 U | * | 12/2015 |
| CN | 204906712 U | | 12/2015 |
| CN | 206272837 U | | 6/2017 |
| CN | 108347679 A | | 7/2018 |

* cited by examiner

HIGH-PITCHED LOUDSPEAKER

CROSS-REFERENCE TO RELATED APPLICATIONS

The present application is the U.S. National Phase under 35. U.S.C. § 371 of International Application PCT/CN2018/106913, filed Sep. 21, 2018, which claims priority of Chinese Patent Application No. CN 201810455443.8, filed on May 14, 2018, the entire content of which is incorporated herein by reference.

FIELD OF THE INVENTION

The invention relates to the field of loudspeaker, in particular to a high-pitched loudspeaker.

BACKGROUND OF THE INVENTION

Existing high-pitched speaker usually comprises frame, a diaphragm arranged on the frame, a voice coil connected to the diaphragm and a magnetic circuit system fixedly connected to the frame. The magnetic circuit systems are divided into an inner magnetic structure and an outer magnetic structure. The inner magnetic structure includes a T-iron, and an air gap cavity is formed between the T-iron and the voice coil and the diaphragm; the outer magnetic structure includes a front plate, a magnetic steel and a U-iron which are sequentially stacked, and an air gap cavity is formed between the front plate and the voice coil and the diaphragm. The air gap cavity of the existing high-pitched loudspeaker is small, the starting frequency is narrow and the distortion is large.

SUMMARY OF THE INVENTION

In order to solve the above-mentioned problems, the present disclosure aims to provide a high-pitched loudspeaker, which widens the starting frequency of the high-pitched loudspeaker, and the high-pitched loudspeaker has a smoother intermediate frequency curve and less distortion.

The present disclosure provides a high-pitched loudspeaker, comprising a magnetic circuit system, a voice coil and a diaphragm connected to the voice coil, a first cavity is formed between the magnetic circuit system and the voice coil and the diaphragm, wherein the high-pitched loudspeaker further comprises a back cover, the magnetic circuit system is arranged between the diaphragm and the back cover, and a second cavity is formed between the back cover and the magnetic circuit system, a through-hole is opened in the magnetic circuit system, and the through-hole communicates the first cavity and the second cavity to form an air gap cavity of the high-pitched loudspeaker.

In an embodiment, the high-pitched loudspeaker further comprises a damping material arranged in the air gap cavity.

In an embodiment, the damping material is arranged in the first cavity and/or the second cavity of the air gap cavity.

In an embodiment, the damping material is arranged between the magnetic circuit system and the back cover and covers the through-hole.

In an embodiment, the damping material is polyurethane foam or foamed rubber or felt.

In an embodiment, one or more though holes are opened in the magnetic circuit system, and the through-hole is a round hole, a elliptical hole or a polygonal hole.

In an embodiment, the magnetic circuit system includes a T-iron, the magnetic steel and the front plate arranged around the T-iron, and the through-hole is arranged on the T-iron.

In an embodiment, the diaphragm is arranged on a frame, the front plate, the magnetic steel and the T-iron are fixedly connected to the frame, and the back cover is fixedly connected to the magnetic steel.

In an embodiment, the magnetic circuit system includes a front plate, a magnetic steel, and a U-iron sequentially arranged, the diaphragm is arranged on a frame, and an outer edge of the U-iron is fixedly connected between the frame, the front plate and the magnetic steel are located between the diaphragm and the U-iron, and the through-hole is arranged on the front plate, the magnetic steel and the U-iron, and sequentially penetrates the front plate, the magnetic steel and the U-iron.

In an embodiment, the back cover is fixedly connected to the frame.

Due to the use of the above scheme, the present disclosure has the following advantages compared with the prior art: a back cover is arranged on the back side of the magnetic circuit system, a through-hole is opened on the magnetic circuit system of the high-pitched loudspeaker, and the cavity at the back of the high-pitched loudspeaker is increased, and the air gap of the high-pitched loudspeaker is increased, such that the FO (loudspeaker's resonance frequency) of the high-pitched loudspeaker is lowered, the intermediate frequency portion of the high-pitched loudspeaker is extended forward further to widen the starting frequency of the high-pitched loudspeaker; the Q (quality factor) value of the high-pitched loudspeaker is reduced, thereby smoothing the intermediate frequency curve of the high-pitched loudspeaker, reducing the distortion of the high-pitched loudspeaker, and improving the sound quality.

BRIEF DESCRIPTION OF THE DRAWINGS

In order to illustrate the technical scheme of the present disclosure more clearly, the drawings used in the description of the embodiments will be briefly introduced below. Obviously, the drawings in the following description are only some embodiments of the present disclosure, and the persons skilled in the art can obtain other drawings according to these drawings without any creative work.

Wherein:

11—panel; 12—diaphragm; 13—voice coil; 14—frame; 15—front plate; 16—magnetic steel; 17—T-iron; 170—through-hole; 18—damping material; 19—back cover; 101—a first cavity; 102—a second cavity;

21—panel; 22—diaphragm; 23—voice coil; 24—frame; 25—front plate; 250—through-hole; 26—magnetic steel; 260—through-hole; 27—U-iron; 270—through-hole; 28—damping material; 29—back cover; 201—first cavity; 202—second cavity.

DETAILED DESCRIPTION OF THE INVENTION

The preferred embodiments of the present disclosure are described in detail below with the drawings in order to make the advantages and features of the present disclosure more readily understood by the persons skilled in the art. It is to be noted that the description of the embodiments is used to help understand the present disclosure, but is not intended to limit the invention. Further, the technical features involved in the various embodiments of the present disclosure described below may be combined with each other as long as they do not constitute a conflict with each other.

Embodiment 1

Figure 1A:
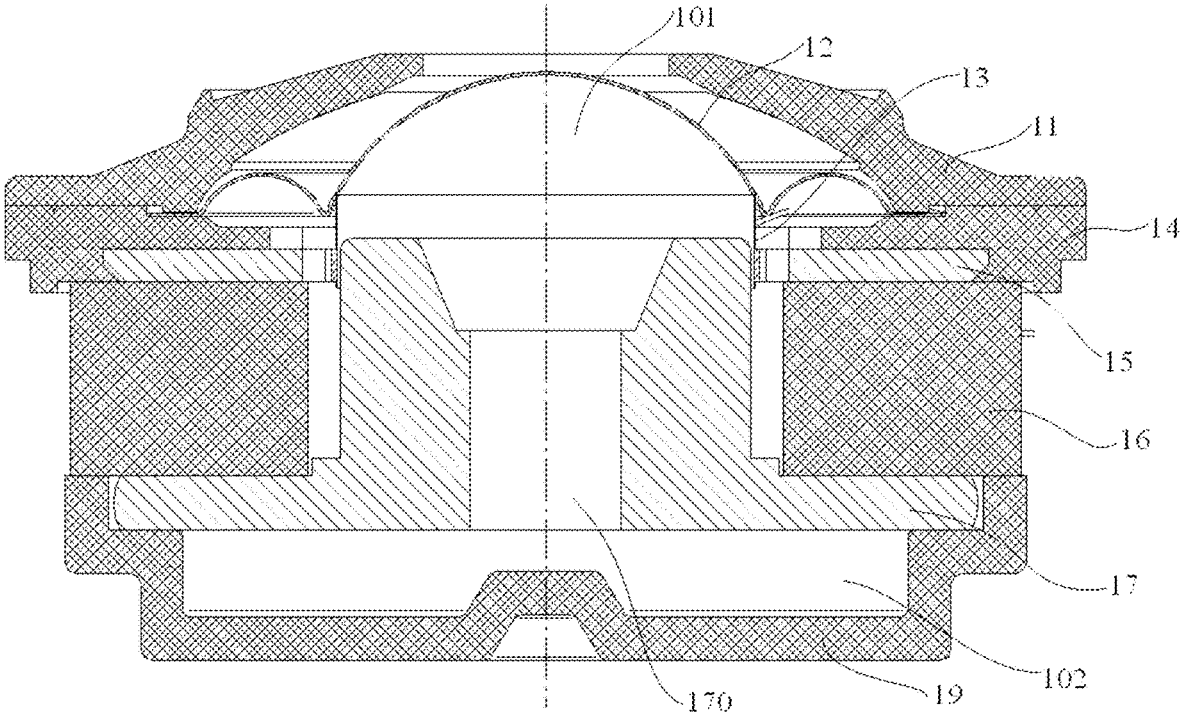
FIGS. 1*a* and 1*b* are respectively sectional views of two types of high-pitched loudspeaker of embodiment 1 of the present disclosure.

FIG. 1*a* shows a high-pitched loudspeaker of the present embodiment, comprising a panel 11, a frame 14, a front plate 15, a magnetic steel 16, and a T-iron 17, which are sequentially fixedly connected, wherein the front plate 15, the magnetic steel 16, and the T-iron 17 constitute a magnetic circuit system of the high-pitched loudspeaker, and the magnetic circuit system is an external magnetic structure. The diaphragm 12 is arranged on the frame 14, and the voice coil 13 is connected to the diaphragm 12, the front plate 15 and the magnetic steel 16 are arranged around the T-iron 17 and form a gap with the outer wall of the T-iron 17 for inserting the voice coil 13, the lower portion of the voice coil 13 is located in the gap, and the diaphragm 12 covers the front surface of the T-iron 17, so that a first cavity 101 is formed between the diaphragm 12, the voice coil 13, and the front surface of the T-iron 17. The high-pitched loudspeaker further comprises a back cover 19 fixedly connected to the back surface of the magnetic steel 16 and the T-iron 17, and the T-iron 17 is located between the diaphragm 12 and the back cover 19, and a second cavity 102 is formed between the back surface of the T-iron 17 and the back cover 19. The T-iron 17 is opened with a through-hole 170 extending from the front surface thereof to the back surface, and the through-hole 170 communicates the first cavity 101 and the second cavity 102 to constitute an air gap cavity of the high-pitched loudspeaker.

Figure 1B:
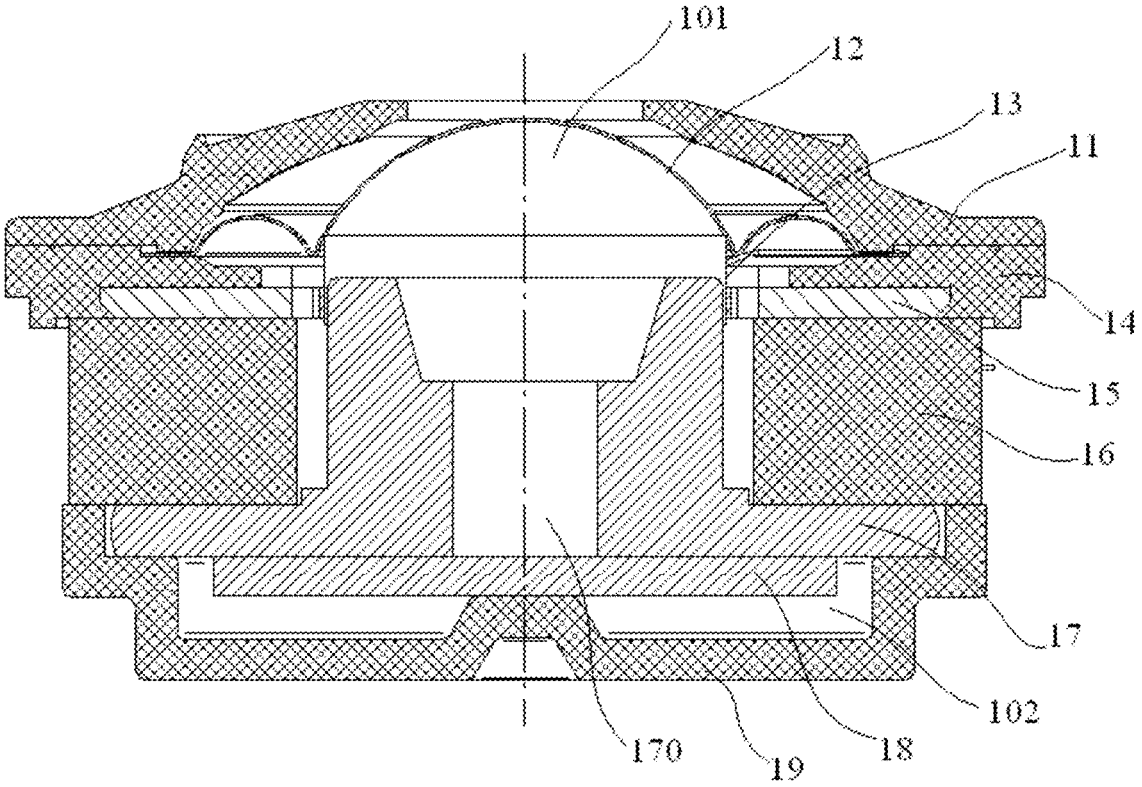
Figure 2:
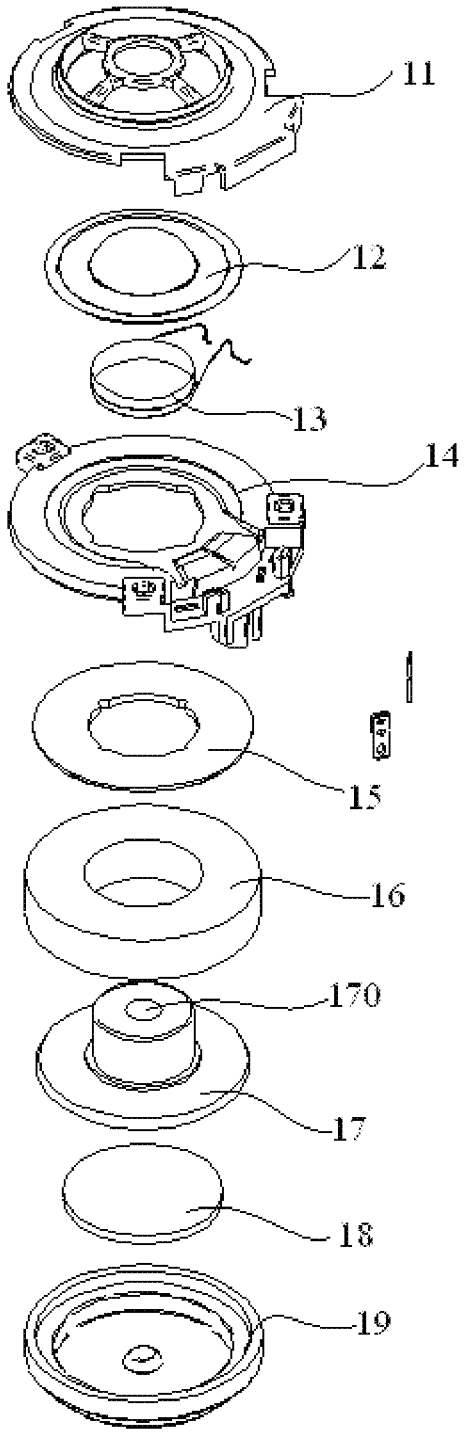
FIG. 2 is an exploded view of embodiment 1 of the present disclosure.
Figures 3A, 3B, 3C, 3D, 3E:
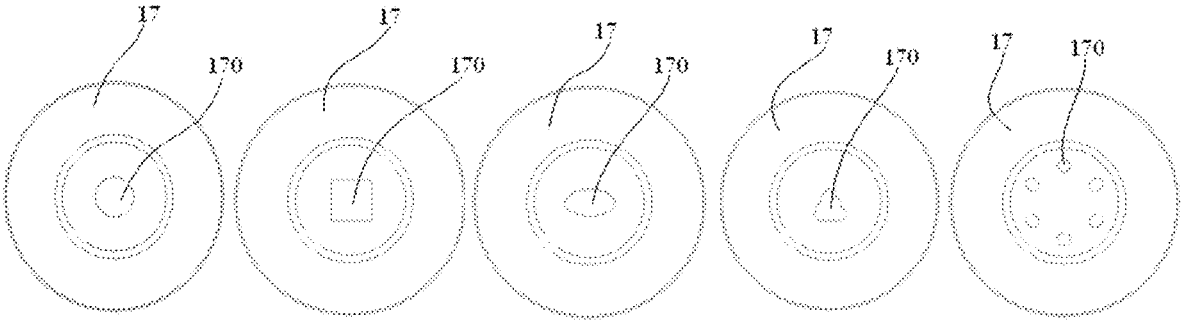
FIGS. 3*a* to 3*e* are top views of several T-irons of embodiment 1 of the present disclosure.

FIG. 1*b* shows another high-pitched loudspeaker of the present embodiment, which is further optimized for the high-pitched loudspeaker shown in FIG. 1. Specifically, referring to FIG. 1*b* and FIG. 2, a damping material 18 is arranged in the air gap chamber, and the damping material 18 is a flexible gas permeable material such as polyurethane foam or foam rubber or felt. The through-hole 170 on the T-iron 17 has various forms, and may be a circular hole, a square hole, an elliptical hole or a triangular hole, as shown in FIGS. 3*a* to 3*d*; the number of the through-hole 170 is one, and may be plural, such as FIG. 3*e* shows a circular arrangement.

Figures 4A, 4B, 4C:
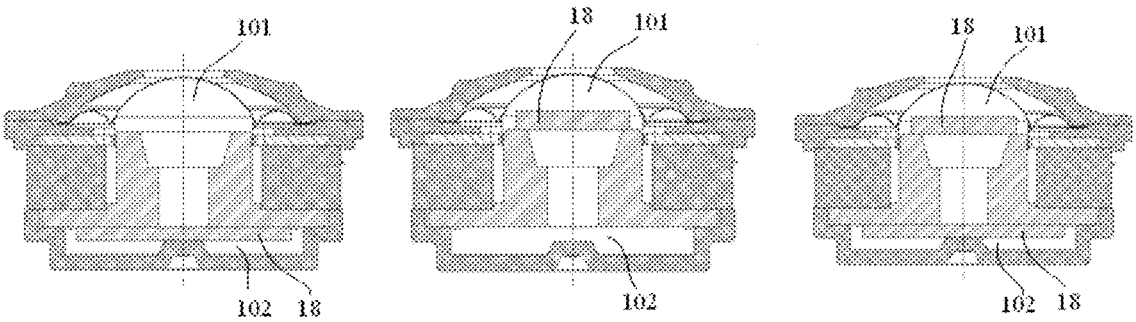
FIGS. 4*a* to 4*c* are schematic views of several damping materials' positions of embodiment 1 of the present disclosure.

The damping material 18 is arranged in a plurality of manners, and may be arranged in the second cavity 102 and embedded between the back surface of the T-iron 17 and the back cover 19 as shown in FIG. 4*a*; or may be arranged in the first cavity 101 as shown in FIG. 4*b*; it may also be partially arranged in the second cavity 102 and another portion in the first cavity 101, as shown in FIG. 4*c*. The damping material 18 covers the front and/or back of the through-hole 170.

Embodiment 2

Figure 5A:
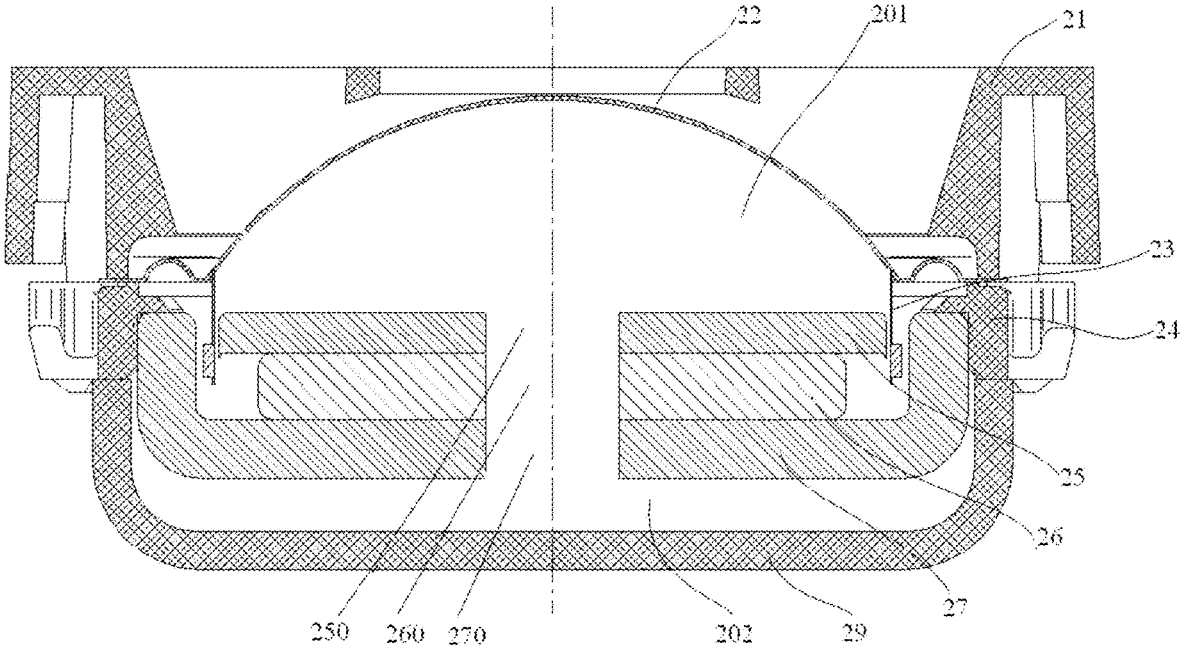
FIGS. 5*a* and 5*b* are exploded views of two types of high-pitched loudspeaker of embodiment 2 of the present disclosure.

FIG. 5*a* shows a high-pitched loudspeaker of the embodiment, comprising a panel 21, a frame 24, a front plate 25, a magnetic steel 26 and a U-iron 27, wherein the front plate 25, the magnetic steel 26 and the U-iron 27 constitute a magnetic circuit system of the high pitch speaker, which is an internal magnetic structure. A diaphragm 22 is arranged on the frame 24, and a voice coil 23 is connected to the diaphragm 22. The outer edge of the U-iron 27 extends upward and is fixedly connected to the lower portion of the frame 24. The magnetic steel 26 is arranged on the U-iron 27, the front plate 25 is arranged on the magnetic steel 26, and the magnetic steel 26 and the front plate 25 are located between the diaphragm 22 and the U-iron 27. A gap is formed between the front plate 25 and the outer edge of the U-iron 27 for inserting the voice coil 23, the lower portion of the voice coil 23 is located in the gap, and the diaphragm 22 covers the front surface of the magnetic circuit system, so that a first cavity 201 is formed between the diaphragm 22, the voice coil 23, and the front surface of the front plate 25. The high-pitched loudspeaker further comprises a back cover 29 fixedly connected to the lower portion of the frame 24 such that the magnetic circuit system is located between the diaphragm 22 and the back cover 29, and a second cavity 202 is formed between the back surface of the U-iron 27 and the back cover 29. The front plate 25, the magnetic steel 26 and the U-iron 27 are respectively opened with through-holes 250, 260, 270 extending from the front surface thereof to the back surface, and the through-holes 250, 260, 270 communicates the first cavity 201 and the second cavity 202 to constitute an air gap cavity of the high-pitched loudspeaker.

Figure 5B:
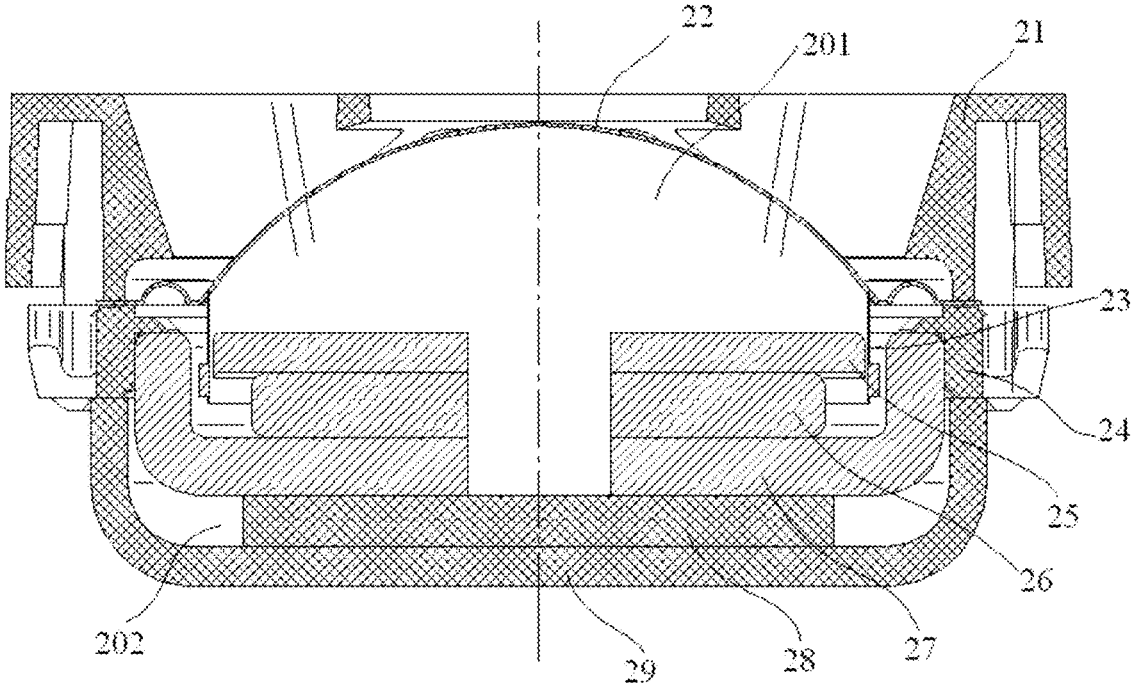
Figure 6:
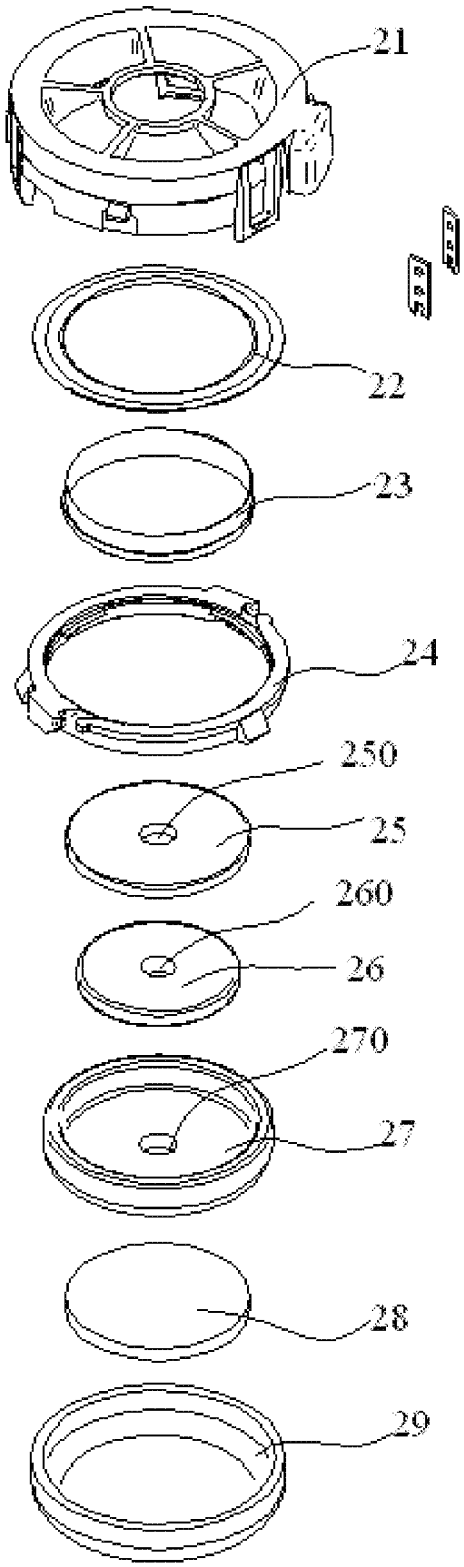
FIG. 6 is an exploded view of embodiment 2 of the present disclosure.
Figure 7A:
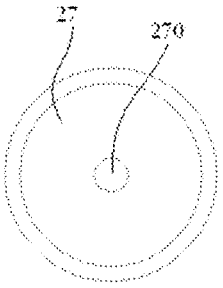
FIGS. 7*a* to 7*e* are top views of several U-irons of embodiment 2 of the present disclosure.
Figure 7B:
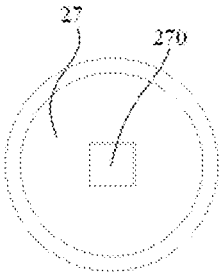
Figure 7C:
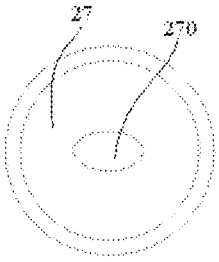
Figure 7D:
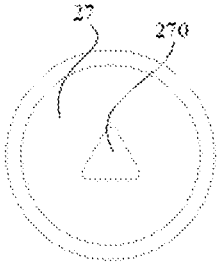
Figure 7E:
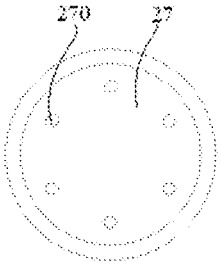

FIG. 5*b* shows another high-pitched loudspeaker of the present embodiment, which is further optimized for the high-pitched loudspeaker shown in FIG. 1. Specifically, referring to FIG. 5*b* and FIG. 6, a damping material 28 is arranged in the air gap chamber, and the damping material 28 is a flexible gas permeable material such as polyurethane foam or foam rubber or felt. The through-holes 250, 260, 270 on the U-iron 27, the magnetic steel 26 and the front plate 25 have various forms, and may be a circular hole, a square hole, an elliptical hole or a triangular hole, as shown in FIGS. 7*a* to 7*d*; the number of each of the through-holes 250, 260, 270 is one, and may be plural, respectively, such as FIG. 7*e* shows a circular arrangement.

Figure 8A:
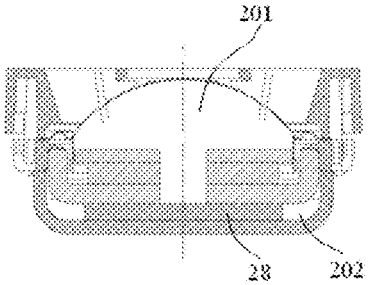
FIGS. 8*a* to 8*c* are schematic views of several damping materials' positions of embodiment 2 of the present disclosure.
Figure 8B:
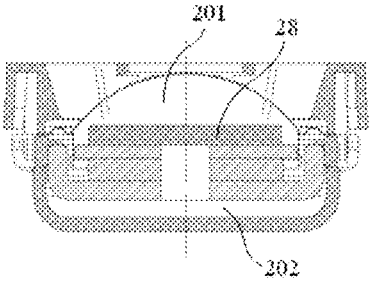
Figure 8C:
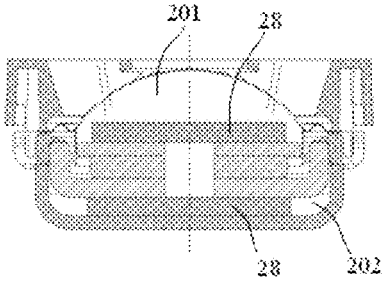

The damping material 28 is arranged in a plurality of manners, and may be arranged in the second cavity 202 and embedded between the back surface of the U-iron 27 and the back cover 29 as shown in FIG. 8*a*; or may be arranged in the first cavity 201 as shown in FIG. 8*b*; it may also be partially arranged in the second cavity 202 and another portion in the first cavity 201. The damping material 28 covers the front and/or back of the through-hole 170 as shown in FIG. 8*c*.

Comparison of Loudspeaker Impedance Curves

Figure 9:
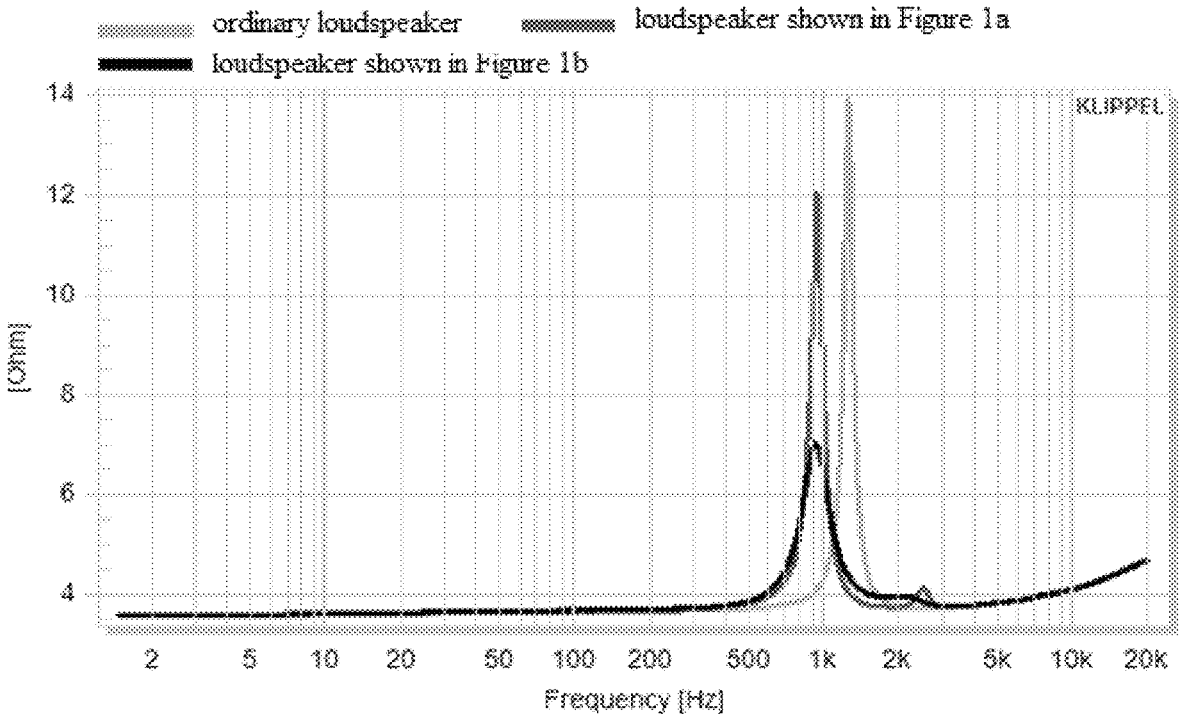
FIG. 9 shows high-pitched impedance curves of the high-pitched loudspeaker of the present disclosure and the existing high-pitched loudspeaker.

Impedance tests of the existing ordinary high-pitched loudspeaker, the high-pitched loudspeaker shown in FIG. 1*a* in the embodiment 1, and the high-pitched loudspeaker shown in FIG. 1*b* in the embodiment 1 are performed to obtain high-pitched loudspeaker impedance curves, as shown in FIG. 9. Wherein, according to the color depth of the curves, the lightest line represents the impedance curve of the ordinary high-pitched loudspeaker, then the impedance curve of the high-pitched loudspeaker shown in FIG. 1*a*, and the deepest line represents the impedance curve of the high-pitched loudspeaker shown in FIG. 1*b*. It can be seen from FIG. 9 that the FO of the ordinary high-pitched loudspeaker is at 1500 Hz and the peak value is 14 ohms; the FO of the high-pitched loudspeaker shown in FIG. 1*a* is at 950 Hz and the peak value is 12 ohms; the FO of the high-pitched loudspeaker shown in FIG. 1*b* is at 950 Hz, the peak value is 7 ohm.

Comparison of Loudspeaker Frequency Response Curves

Figure 10:
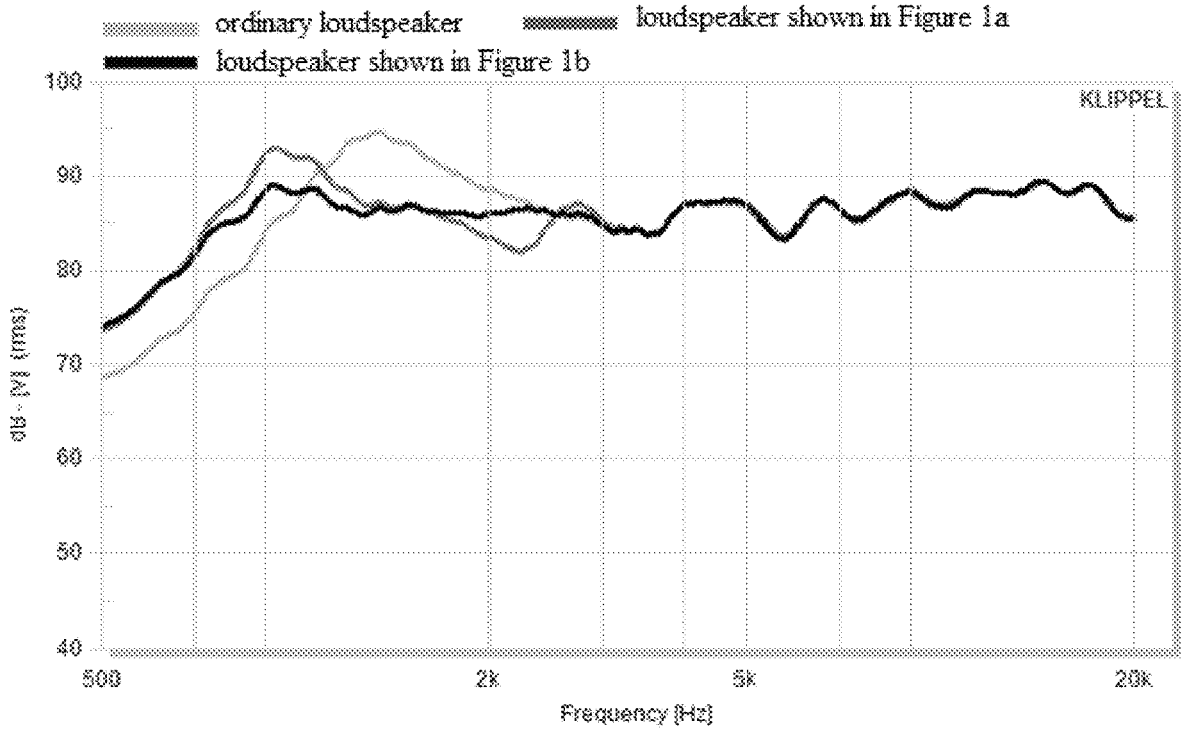
FIG. 10 shows high-pitched frequency response curves of the high-pitched loudspeaker of the present disclosure and the existing high-pitched loudspeaker.

Frequency response tests of the existing ordinary high-pitched loudspeaker, the high-pitched loudspeaker shown in FIG. 1*a* in the embodiment 1, and the high-pitched loudspeaker shown in FIG. 1*b* in the embodiment 1 are performed to obtain high-pitched loudspeaker frequency response curves, as shown in FIG. 10. Wherein, according to the color depth of the curve, the lightest line represents the frequency response curve of the ordinary high-pitched loudspeaker, then the frequency response curve of the high-pitched loudspeaker shown in FIG. 1*a*, and the deepest line represents the frequency response curve of the high-pitched loudspeaker shown in FIG. 1*b*. It can be seen from FIG. 10 that the FO of the ordinary high-pitched loudspeaker is at 1500 Hz and the curve fluctuate is 10 dB; the FO of the high-pitched loudspeaker shown in FIG. 1*a* is at 950 Hz and the curve fluctuate is 10 dB; the FO of the high-pitched loudspeaker shown in FIG. 1*b* is at 950 Hz, the curve fluctuate is 5 dB.

Comparison of Loudspeaker Distortion Curves

Figure 11:
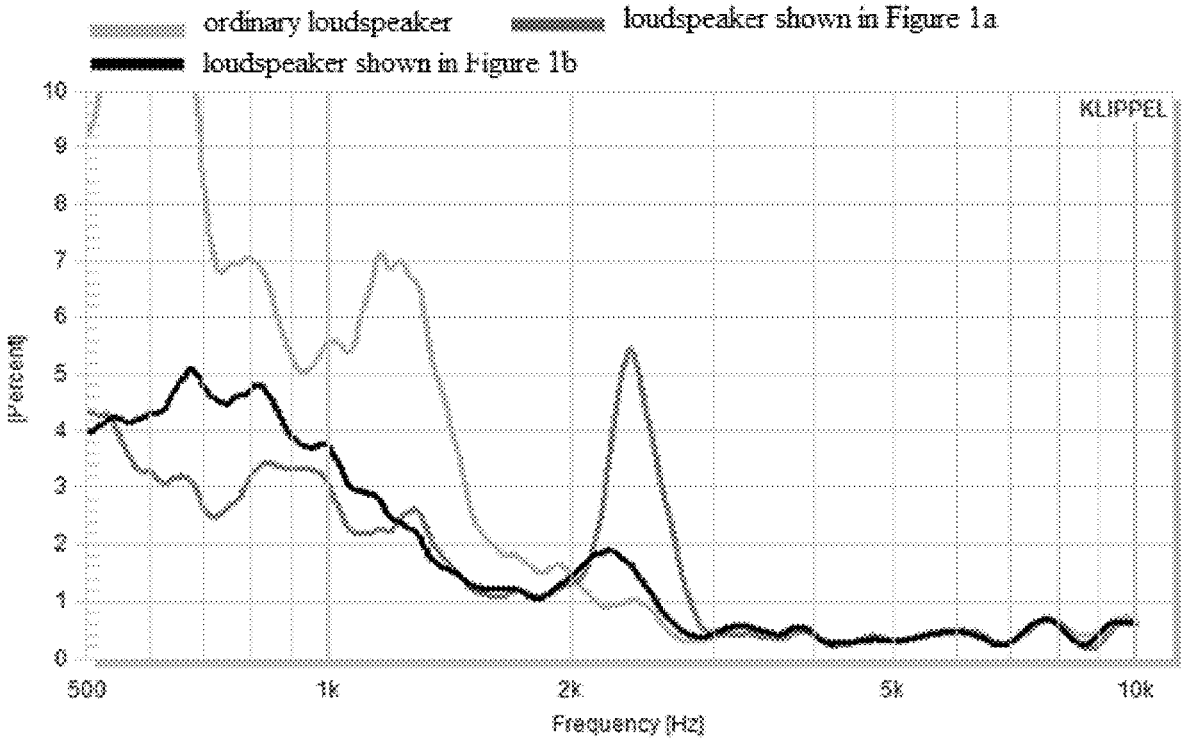
FIG. 11 shows high-pitched distortion curves of the high-pitched loudspeaker of the present disclosure and the existing high-pitched loudspeaker.

Distortion tests of the existing ordinary high-pitched loudspeaker, the high-pitched loudspeaker shown in FIG. 1*a* in the embodiment 1, and the high-pitched loudspeaker shown in FIG. 1*b* in the embodiment 1 are performed to obtain high-pitched loudspeaker distortion curves, as shown in FIG. 11. Wherein, according to the color depth of the curve, the lightest line represents the distortion curve of the ordinary high-pitched loudspeaker, then the distortion curve of the high-pitched loudspeaker shown in FIG. 1*a*, and the deepest line represents the distortion curve of the high-pitched loudspeaker shown in FIG. 1*b*. It can be seen from FIG. 11 that the ordinary high-pitched loudspeaker has a 1.3K Hz distortion of 7%; the high-pitched loudspeaker shown in FIG. 1*a* has a 2.5K Hz distortion of 5.5%; the high-pitched loudspeaker shown in FIG. 1*b* has a 1.3K Hz distortion of 3% and a 2.5 K Hz distortion of 2%.

By increasing the cavity at the back of the high-pitched loudspeaker, and increasing the air gap of the high-pitched loudspeaker, the FO of the high-pitched loudspeaker is lowered, the intermediate frequency portion of the high-pitched loudspeaker is extended forward further to widen the starting frequency of the high-pitched loudspeaker. Open a through-hole in the magnetic circuit system of the high-pitched loudspeaker (T-iron 17 or front plate 25, magnetic steel 26, U-iron 27), then introduce a back cover on the back, and introduce damping material, to reduce the Q value of the high-pitched loudspeaker, thereby smoothing the intermediate frequency curve of the high-pitched loudspeaker, reducing the distortion of the high-pitched loudspeaker, and improving the sound quality.

The above embodiments are only to illustrate the technical conception and characteristics of the present disclosure, and are a preferred embodiment. It is intended that the persons skilled in the art will be able to understand the contents of the present disclosure and implement it accordingly, but does not limit the protection scope of the present disclosure.

What is claimed is:

1. A high-pitched loudspeaker comprising:

a magnetic circuit system;

a voice coil;

a diaphragm connected to the voice coil, wherein a first cavity is formed between the magnetic circuit system and the voice coil and the diaphragm;

a back cover, the magnetic circuit system being arranged between the diaphragm and the back cover, wherein a second cavity is formed between the back cover and the magnetic circuit system, and a through-hole is opened in the magnetic circuit system, the through-hole communicates the first cavity and the second cavity to form an air gap cavity of the high-pitched loudspeaker, the high-pitched speaker further comprising a damping material arranged in the air gap cavity; and a frame and a panel with a hole opened on a middle portion thereof, the diaphragm and the panel being arranged on the frame and the panel is covered above the diaphragm;

wherein the diaphragm has a first edge portion close to the frame and the panel has a second edge portion above the first edge portion, and a gap is formed between the first edge portion and the second edge portion, the gap being smaller than a distance between other portions of the diaphragm and the panel;

wherein the damping material is polyurethane foam or foamed rubber or felt.

2. The high-pitched loudspeaker according to claim 1, wherein the damping material is arranged in the first cavity and/or the second cavity of the air gap cavity.

3. The high-pitched loudspeaker according to claim 2, wherein the damping material covers the through-hole.

4. The high-pitched loudspeaker according to claim 1, wherein said though hole is opened in the magnetic circuit system, and the through-hole is a round hole, a elliptical hole or a polygonal hole.

5. The high-pitched loudspeaker according to claim 1, wherein the through-hole is a square hole or a triangular hole.

6. The high-pitched loudspeaker according to claim 1, wherein the magnetic circuit system includes a T-iron, a magnetic steel and a front plate arranged around the T-iron, and the through-hole is arranged on the T-iron.

7. The high-pitched loudspeaker according to claim 6, wherein the the front plate, the magnetic steel and the T-iron are fixedly connected to the frame, and the back cover is fixedly connected to the magnetic steel.

8. The high-pitched loudspeaker according to claim 1, wherein the magnetic circuit system includes a front plate, a magnetic steel and a U-iron sequentially arranged, and an outer edge of the U-iron is fixedly connected between the frame, the front plate and the magnetic steel are located between the diaphragm and the U-iron, and the through-hole is arranged on the front plate, the magnetic steel and the U-iron, and sequentially penetrates the front plate, the magnetic steel and the U-iron.

9. The high-pitched loudspeaker according to claim 8, wherein the back cover is fixedly connected to the frame.

* * * * *